United States Patent [19]

Sciola et al.

[11] 4,438,554

[45] Mar. 27, 1984

[54] RAM DRIVE CHUCK

[76] Inventors: Joseph Sciola, 98 Glenwood Dr., North Heldon, N.J. 07058; Gabor Nagy, 98 W. First St., Clifton, N.J. 07011

[21] Appl. No.: 265,034

[22] Filed: May 18, 1981

[51] Int. Cl.[3] ..... B23P 5/00; B65H 17/02

[52] U.S. Cl. ..... 29/57; 242/68.4; 279/9 R

[58] Field of Search ..... 29/27 R, 56.6, 57; 242/68.4; 279/4 R, 9 R

[56] References Cited

U.S. PATENT DOCUMENTS

| | | | |
|---|---|---|---|
| 778,979 | 1/1905 | Larson | 242/68.4 |
| 1,378,305 | 5/1921 | Wood et al. | 242/68.4 |
| 1,904,913 | 4/1933 | Adams, Jr. | 242/68.4 |
| 2,252,353 | 8/1941 | Pierce | 242/68.4 X |
| 2,759,679 | 8/1956 | Torresgrossa et al. | 242/68.4 |
| 2,968,448 | 1/1961 | Drum | 242/68.4 X |
| 4,105,171 | 8/1978 | Sciola et al. | 242/68.4 |

FOREIGN PATENT DOCUMENTS

| | | | |
|---|---|---|---|
| 1136182 | 9/1962 | Fed. Rep. of Germany | 242/68.4 |
| 1176751 | 1/1970 | United Kingdom | 242/68.4 |
| 405740 | 3/1974 | U.S.S.R. | 242/68.4 |
| 197609 | 9/1976 | U.S.S.R. | 242/68.4 |

*Primary Examiner*—William R. Briggs

*Attorney, Agent, or Firm*—James J. Romano, Jr.

[57] ABSTRACT

New and improved ram drive chuck is provided and comprises workpiece driving means which are moveable between an extended position thereof relative to an appropriately positioned workpiece wherein the workpiece driving means are operable to drivingly engage, support and rotate the workpiece, and a retracted workpiece driving means position relative to the appropriately positioned workpiece wherein the workpiece driving means are disengaged from the workpiece. Means to positively disengage the workpiece driving means from the workpiece upon movement of the former into the retracted position thereof are operable attendant the drive of a specified form of workpiece.

4 Claims, 6 Drawing Figures

RAM DRIVE CHUCK

BACKGROUND OF THE INVENTION

1. Field of the Invention

This invention relates to a new and improved ram drive chuck which is particularly, though by no means exclusively, adapted for use in the controlled, driven winding and/or unwinding of large, relatively heavy rolls of material.

2. Description of the Prior Art

Although a wide variety of drive chucks are, of course, known in the prior art, none are known to applicants which can function to both positively engage and disengage, as by inward and outward ramming, and drive, a workpiece in the carefully controlled, safe and particularly effective manner described in detail hereinbelow. More specifically, and taking for example the safety drive chucks as disclosed in our commonly owned U.S. Pat. Nos. 3,777,999 and 4,105,171—which United States Patents represent the most relevant prior art known to applicants—it may readily be seen that, although those drive chucks operate remarkably well in the performance of the disclosed functions thereof, i.e. the absolutely safe drive of workpieces such as driven shafts even under conditions of high drive chuck torque loadings, no capability is included therein for the automatic and positive engagement and disengagement thereof with the workpiece to be driven thereby. Too, and although a variety of devices are, of course, known which operate to ram a workpiece into engagement with a drive chuck or like drive means, no such device is known which combines the ramming and driving functions in the carefully controlled, safe and particularly effective manner of the ram drive chuck of our invention.

OBJECTS OF THE INVENTION

It is, accordingly, an object of our invention to provide new and improved ram drive chuck which is operable to positively engage and disengage, and drive, a workpiece.

Another object of our invention is the provision of a ram drive chuck as above which provides for the particularly safe and carefully controlled engagement, disengagement and drive of a workpiece.

Another object of our invention is the provision of a ram drive chuck as above which is of relatively simple design and construction, and which requires the use of only readily available components and materials of proven dependability in the fabrication thereof.

A further object of our invention is the provision of a ram drive chuck as above which is simple to operate and which, because of the combined engagement, disengagement and drive functions thereof, simplifies the handling of materials which are to be operated on thereby.

SUMMARY OF THE DISCLOSURE

As disclosed herein, the new and improved ram drive chuck of our invention comprises a drive shaft from which is slidably carried for driven rotation therewith a shaft housing and a bull nose or like assembly. The shaft housing is rotatably disposed within a chuck actuating piston and is moveable therewith, along with the bull nose assembly, between a retracted piston position wherein the ram drive chuck is "closed" and the bull nose assembly is inoperative to support and drivingly engage a workpiece such as the support rod or core for a roll of material, and an extended piston position wherein the ram drive chuck is "open" and the bull nose assembly is operative to positively support and drivingly engage such workpiece.

DESCRIPTION OF THE DRAWINGS

The above and other objects and significant advantages of our invention are believed made clear by the following detailed description thereof taken in conjunction with the accompanying drawings wherein.

DETAILED DESCRIPTION OF THE INVENTION

Figure 1:
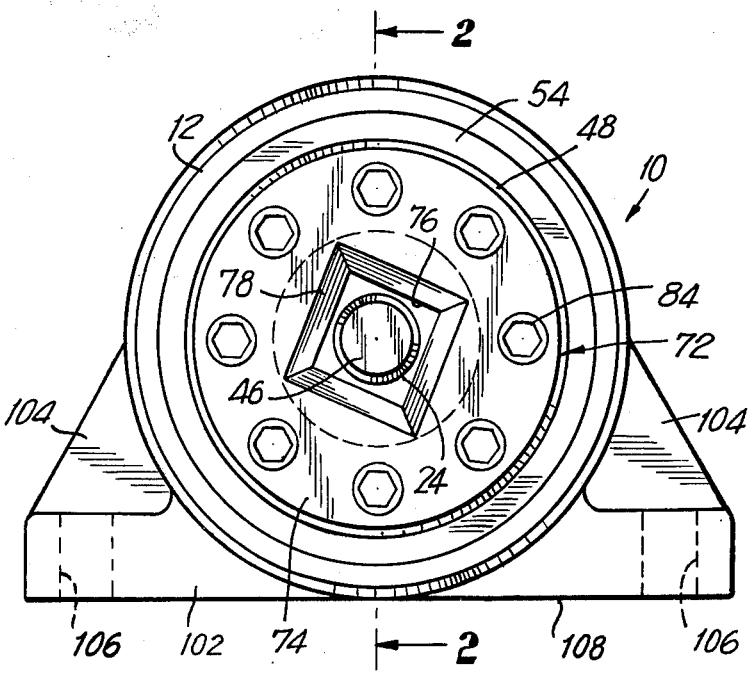
FIG. 1 is an end view of a foot mounted, new and improved ram drive chuck constructed and operative in accordance with the teachings of our invention.
Figure 2:
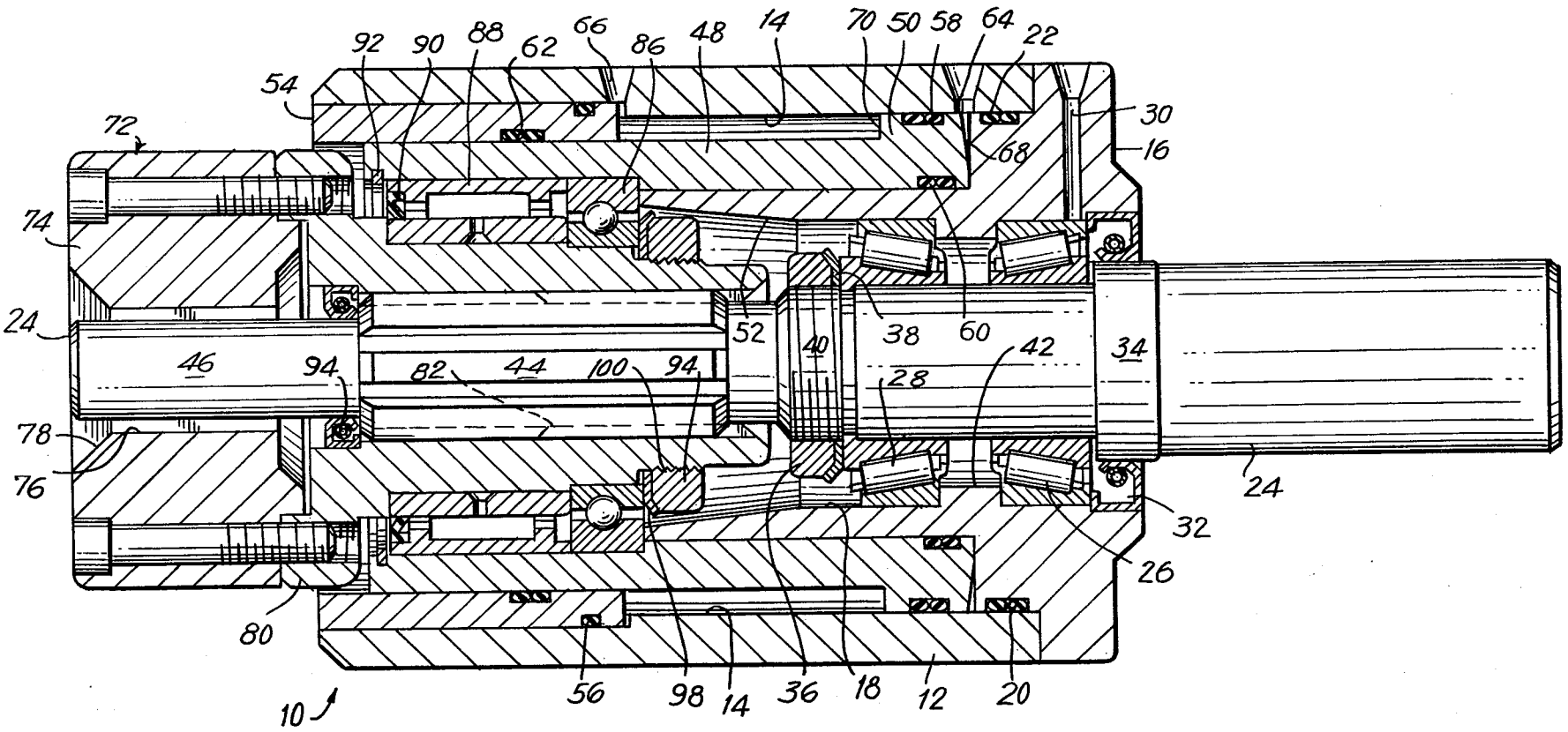
FIG. 2 is a cross-sectional view taken along line 2—2 in FIG. 1 and depicts the ram drive chuck in the retracted or inoperative position thereof.

Referring now to FIGS. 1 and 2, a new and improved ram drive chuck constructed and operative in accordance with the teachings of our invention is indicated generally at 10; it being understood that, unless otherwise indicated, all parts are fabricated from an appropriate metal in the nature of steel. A cylindrical body member is indicated at 12 and includes a stepped bore 14 extending as shown generally longitudinally thereof. A stepped, generally cylindrical rear housing is indicated at 16, and comprises a stepped bore 18 extending as shown generally longitudinally thereof. The rear housing extends as shown into the bore 14 in the body member 12 at the rear of the latter, and is fixedly secured therein in any appropriate manner, for example, by press-fitting. A groove 20 is formed as shown in the rear housing 16 and O-rings 22 are disposed therein to cooperate with the surface of bore 14 in body member 12 to provide a fluid-tight seal between the body member and rear housing.

A stepped drive shaft is indicated at 24 and is supported and journalled for rotation as shown within bore 18 or rear housing 16 by canted roller bearing assemblies 26 and 28; and a lubrication port 30 is provided in the rear housing for the supply of lubricating oil to those bearing assemblies and the general internal cavity of the ram drive chuck 10 as described in greater detail hereinbelow. An oil seal assembly 32 is disposed as shown in the rear housing bore 18 between a boss 34 on the shaft 24 and the rear housing to prevent oil leakage from the rear of the ram drive chuck 10. A lock nut and washer are indicated at 36 and 38, respectively, and are secured as shown on a suitably threaded boss 40 of shaft 24; while a boss 42 is provided on the surface of bore 18 to cooperate as shown with the bearing assemblies 26 and 28. Under these circumstances, it will be clear that the bearing assemblies will be effectively retained in the depicted positions thereof relative to shaft 24 and rear housing 16, while additionally functioning to absorb thrust loadings placed on the shaft. Further included in drive shaft 24 are a splined drive section 44 and an end section 46, respectively.

A generally cylindrical piston is indicated at 48 and comprises an enlarged piston head 50, and a bore 52 extending longitudinally of the piston as shown. A sleeve, preferably of bronze, is indicated at 54 and is disposed as shown in bore 14 of the body member 12; and an "O" ring seal 56 is disposed as shown in a groove in sleeve 54 to provide a fluid-tight seal between the sleeve and body member 12. The piston 48 is slidably disposed in body member 12, and "O" ring seals 58, 60 and 62 are respectively provided as shown in grooves in the enlarged piston head 50, and sleeve 54, for obvious purpose. Pressurized fluid ports are indicated at 64 and 66 and extend as shown at spaced locations through the body member 12 into communication with slanted piston head faces 68 and 70 as are formed to opposite sides of the piston head 50. Suitably valved sources (not shown) of an appropriate pressurized fluid, for example compressed air, are respectively connected to ports 64 and 66 as indicated on FIG. 4 of the drawings. Under these circumstances, it will be clear that, with piston 48 in the retracted position thereof of FIG. 2 relative to body member 12, the introduction of pressurized fluid through port 64 to act on slanted piston head face 68, with concomitant venting of port 66, as to atmosphere, will result in the drive of the piston 48 to the extended position thereof of FIG. 4. Conversely, with the piston 48 in the extended position thereof of FIG. 4, it will be clear that the introduction of pressurized fluid through port 66 to act on slanted piston head face 70, with concomitant venting of port 64, will result in the drive of piston 48 to the retracted position thereof of FIG. 2.

A bull nose assembly is indicated generally at 72 and comprises a socket member 74 having a generally quadrangular drive socket 76 formed generally centrally thereof and including a relieved face 78. A stepped, generally cylindrical shaft housing is indicated at 80 and comprises a splined bore 82 which slidably mates as shown with the splined section 44 of the drive shaft 24, thus supporting, in part, the shaft housing from the drive shaft, and providing for the driven rotation of the shaft housing by the drive shaft. The bull nose assembly 72 is secured as shown to the shaft housing 80 by a generally circular array of spaced attachment bolts 84 which extend as shown through bores in socket member 74 into suitably threaded apertures in shaft housing 80.

The shaft housing 80 is carried as shown from the piston 48, with freedom for rotation relative thereto, by bearings 86 and 88; and an oil seal 90 and retaining ring 92 are provided adjacent bearing 88 for obvious purpose. In like manner, an oil seal 94 is provided between the shaft housing 80 and the end portion 46 of shaft 24. A lock nut 96 and lock washer 98 are secured as shown around a suitably threaded portion 100 of the shaft housing 80 to retain the bearings 86 and 88 as depicted relative to the shaft housing.

With the drive shaft 24 and shaft housing 80 relatively arranged and disposed as described, it will be understood that lubricating oil which is introduced as described hereinabove through port 30 to lubricate shaft bearings 26 and 28, will flow from the latter into and through the cavity between the drive shaft 24, and the piston 48 and rear housing 16 for lubrication of the complementally splined drive shaft and shaft housing sections, for lubrication of the interface between the piston 48 and the rear housing 16, and for lubrication of the shaft housing bearings 86 and 88; with oil seals 32 and 94 functioning to prevent leakage of the lubricating oil from the ram drive chuck 10 at opposite internal ends of the drive shaft 24.

Figure 3:
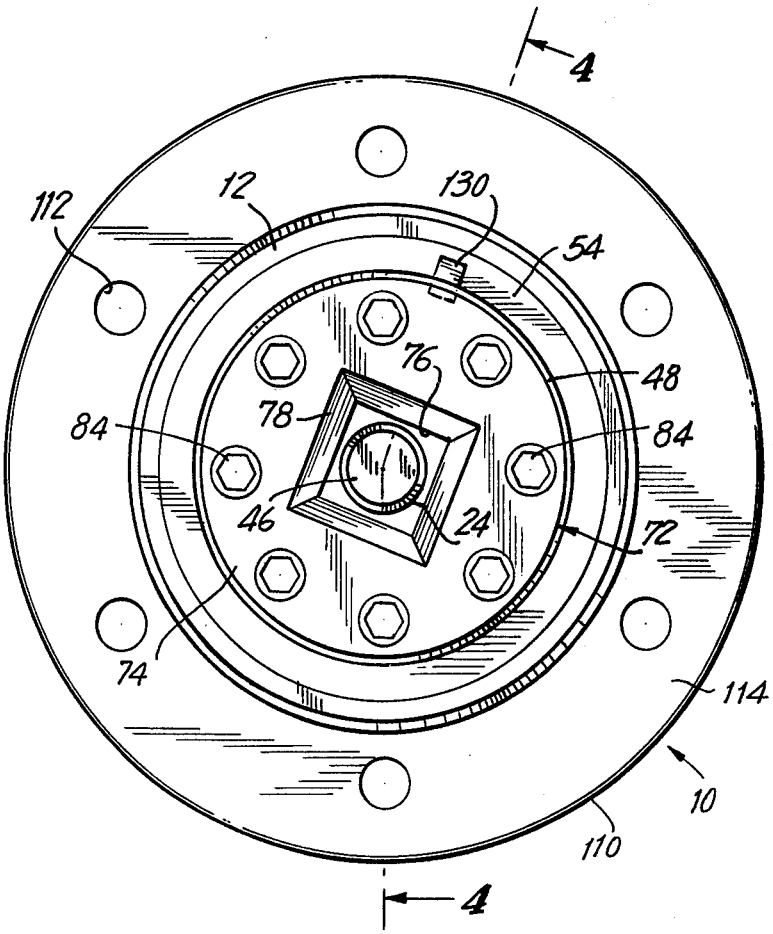
FIG. 3 is an end view of a flange mounted, new and improved ram drive chuck constructed and operative in accordance with the teachings of our invention.
Figure 4:
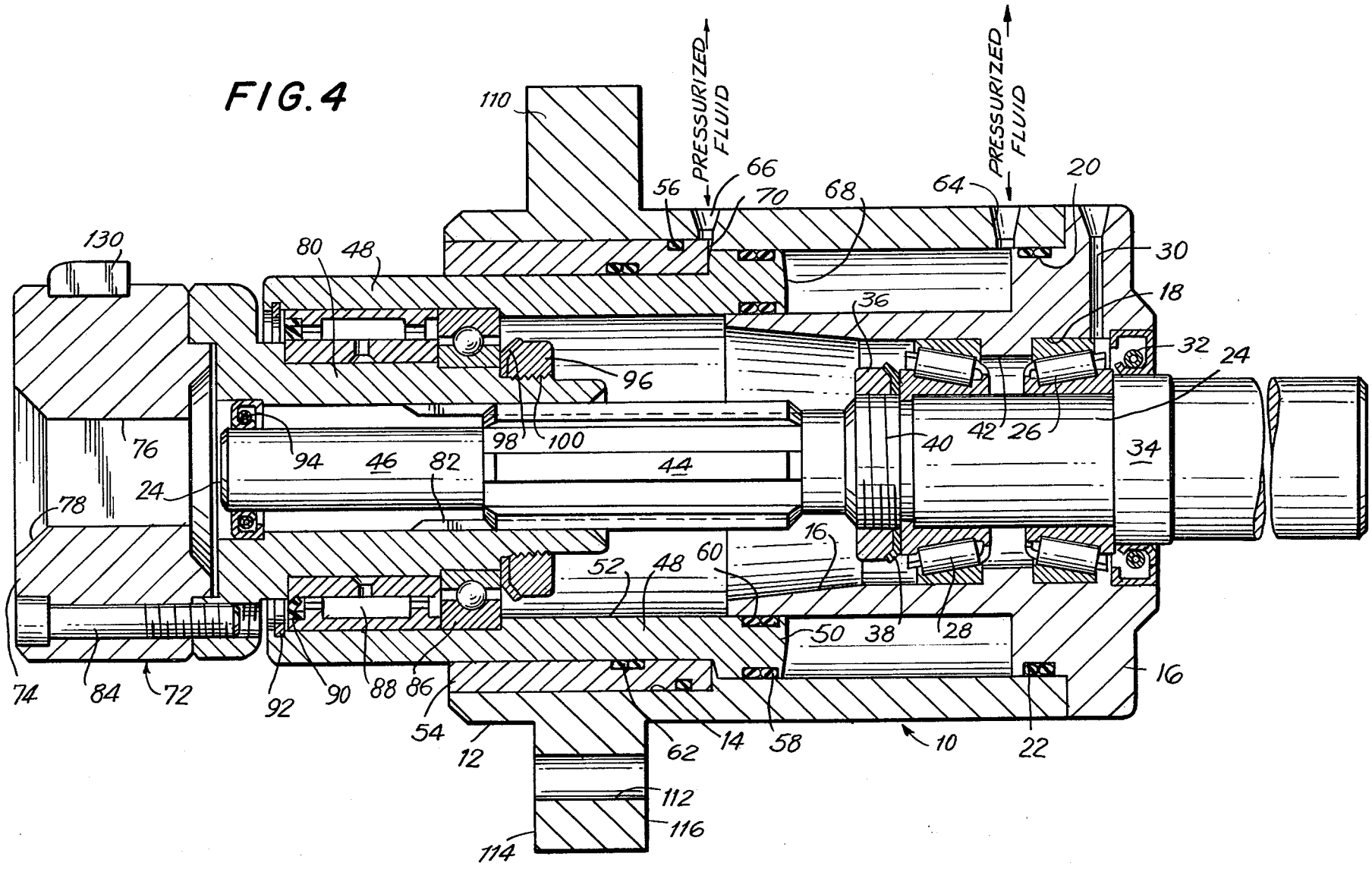
FIG. 4 is a cross-sectional view taken along line 4—4 in FIG. 3 and depicts the ram drive chuck in the extended, operative position thereof.

Different mounting means for the secure mounting of the ram drive chuck 10 of our invention are depicted in FIGS. 1 and 2, and in FIGS. 3 and 4, respectively. More specifically, and for mounting of the ram drive chuck 10 from a pedestal or like base member having a suitably apertured, flat and horizontal chuck support surface, a mounting foot 102 as seen in FIG. 1, and including reinforcing ribs 104 and mounting apertures 106, may be fabricated integrally with the cylindrical chuck body member 12 to extend generally downwardly therefrom and provide a flat chuck mounting surface 108; it being understood that suitable mounting bolts would, of course, be passed through and secured in the respective mounting apertures 106 and the like apertures in the non-illustrated chuck support surface to absolutely secure the mounting of the chuck.

Alternatively, and for mounting of the ram drive chuck 10 from an upstanding support member in the nature of a mounting frame or the like having a suitably apertured, flat and vertical chuck support surface, a circular mounting flange 110 as seen in FIGS. 3 and 4, and including a generally circular array of spaced mounting apertures 112, may be fabricated integrally with the cylindrical chuck body member 12 to extend generally radially outward thereof and provide flat chuck mounting surfaces 114 and 116; it again being understood that suitable mounting bolts would be passed through and secured in the respective mounting apertures 112 and the like apertures in the non-illustrated chuck support surface(s) to absolutely secure chuck mounting.

Figure 5A:
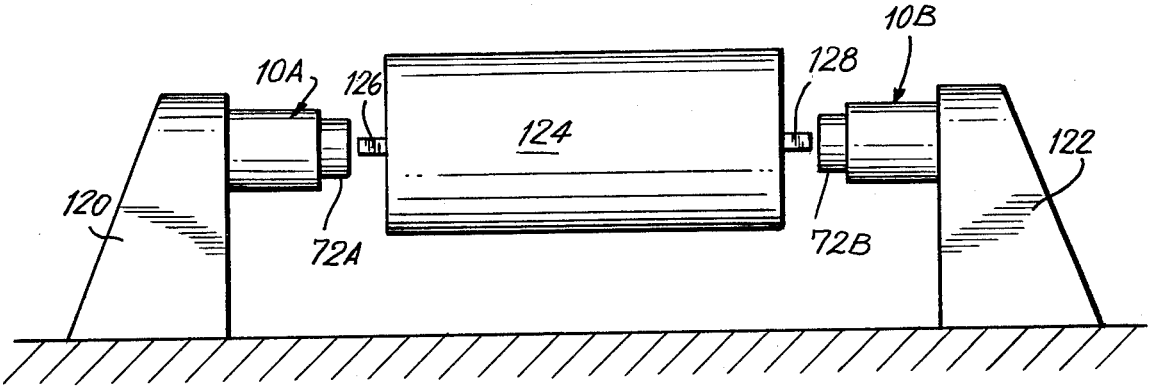
FIGS. 5A and 5B are respectively side elevational views illustrating a representative utilization of the new and improved ram drive chuck of our invention.
Figure 5B:
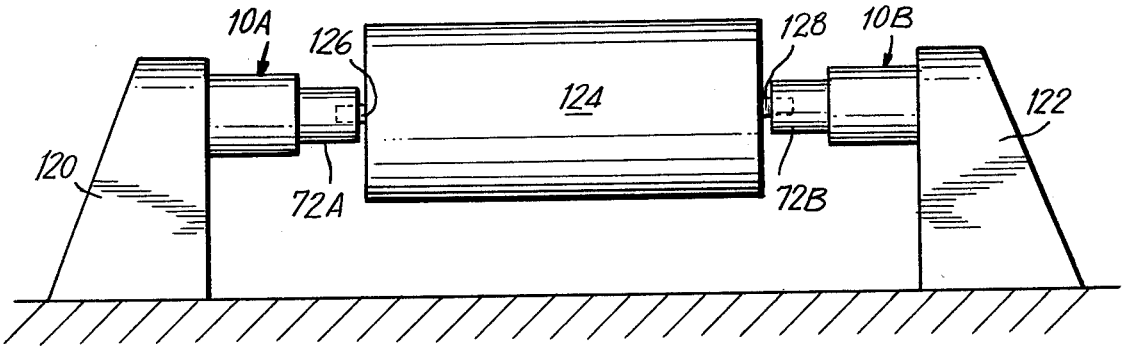

Referring now to FIGS. 5A and 5B for the description of a representative utilization of the new and improved ram drive chuck of our invention, two of the latter are indicated at 10A and 10B in those drawing Figures, and respectively include bull nose assemblies 72A and 72B. The ram drive chucks 10A and 10B are mounted as shown from spaced mounting structures 120 and 122; it being understood that suitable chuck drive shaft drive means and sources of pressurized fluid, not shown, would be included therein to rotate the chuck drive shafts, and operate the chuck pistons through ports 64 and 66 as described in detail hereinabove. A roll of representative material, for example copper, is indicated at 124 and may be understood to be wound around a suitable core, not shown, which terminates in projecting, quadrangular bar sections 126 and 128 of size and shape complemental with regard to the quadrangular bull nose drive sockets 76 (FIGS. 1 through 4). With the material roll 124 initially supported as seen in FIG. 5A relative to the ram drive chucks 10A and 10B by non-illustrated material handling means, for example a fork lift truck or the like, in such manner that the respective bar sections 126 and 128, and bull nose drive sockets 76, are in alignment, and with the respective ram drive chuck pistons 48 in the retracted positions thereof of FIG. 2 to "close" the drive chucks, it will be understood the introduction of pressurized fluid into chuck ports 64 will function as described hereinabove to forcibly move the respective chuck pistons 48, the chuck shaft housings 80, and the chuck bull nose assemblies 72 to the respective extended positions thereof to "open" the ram drive chucks and forcibly and securely drivingly engage the respective bar sections 126 and 128 in the respective drive sockets 76, all in the manner made clear by FIG. 5B. Of course, the relieved faces 78 of the drive sockets 76 will materially assist in such engagement.

With the roll of material 124 supported and drivingly engaged as described by the ram drive chucks 10A and 10B, it may be understood that the fork lift truck or like support device would be removed and the fully controlled driven rotation of the material roll by the ram drive chucks effected in normal manner. Of particular significance are the facts that engagement and support of the roll 124 is rapidly, positively and conveniently effected, and that such engagement is absolutely safe, there being virtually no possibility of the roll 124 falling from the ram drive chucks 10A and 10B for so long as the latter are maintained in the respective "open" positions thereof.

Upon completion of the driven winding and/or unwinding or the like of the material from roll 124, it may be understood that the fork lift truck would again be disposed, if necessary depending on the amount, if any, of material remaining on the roll 124, below the latter and pressurized fluid introduced through chuck ports 66 to drive the respective chuck pistons 48, shaft housings 80 and bull nose assemblies 72 to the respective retracted positions thereof of FIG. 2 to "close" the ram drive chucks. As a result, the respective bar sections 126 and 128 will be released from the respective chuck drive sockets 76; it being noted that, since retraction of the bull nose assemblies results in the total occupation of the drive sockets 76 by chuck drive shaft end portions 46 as seen in FIG. 2, the respective bar sections 126 or 128 would, if necessary, be forcibly and positively driven therefrom to thus positively eliminate the particularly dangerous possibility of one of said bar sections remaining engaged by one of said drive sockets and the other released with resultant tilting and falling of the material roll 124 to potentially fatal consequences with regard to the ram drive chuck operating personnel.

Additional workpiece engaging means to adapt the bull nose assembly 72 to the positive internal, as well as external as described, engagement and drive of workpieces are depicted in FIGS. 3 and 4 and, as seen therein, comprise a rounded, drive key 130 which is disposed as shown in a suitable keyway on the circumference of the bull nose assembly. With the drive key 130 emplaced as shown, and with the roll of material 124 supported from a tubular support core or the like having an internal diameter just slightly larger than the external diameter of the bull nose assembly 72, and including longitudinally extending internal keyways formed in each end thereof and sized and shaped complementally with regard to the chuck drive keys 130, it will be understood by those skilled in this art that actuation as described of the ram drive chucks 10A and 10B to the respective "open" positions thereof under the ram drive chuck-material roll conditions of FIG. 5A with the respective ram chuck drive keys and support core keyways in alignment, will result in the respective bull nose assemblies being forcibly driven into the tubular support core and attendant positive driving engagement of the ram chuck drive keys in the support core keyways.

Although described by way of representative ram drive chuck utilization as comprising the use of two of the same to engage and drive a roll of material, it will be understood that, as an alternative, only one ram drive chuck may be used to that purpose with the other end of the material roll support bar or rod or the like being simply supported for rotation in any suitable manner. Too, and although disclosed by way of example as comprising a bull nose assembly for engagement and drive of the material roll, it will be understood that a wide variety of other and different engaging and driving means may be substituted therefor and suitably attached to the shaft housing 80 for use with the ram drive chuck of our invention.

Various changes in the hereindisclosed embodiment of the ram drive chuck of our invention may, of course, be made without departing from the spirit and scope of that invention as defined in the appended claims.

What is claimed is:

1. In a ram drive chuck for the driven rotation of workpieces and including a housing and a drive shaft supported for rotation in said housing, the improvements comprising, workpiece driving means which are operable to drivingly engage, support and rotate a workpiece, means slidably supporting said workpiece driving means at least in part within said housing, means rotatably supporting said workpiece driving means at least in part within said housing, said workpiece driving means being slidably drivingly engaged by said drive shaft for driven rotation of the workpiece driving means by the drive shaft, said workpiece driving means being slidable relative to said housing between an extended workpiece driving means position wherein the workpiece driving means are operable to drivingly engage, support and rotate an appropriately positioned workpiece, and a retracted workpiece driving means position wherein the same are not operable to drivingly engage, support and rotate said appropriately positioned workpiece whereby, with a workpiece appropriately positioned relative to said ram drive chuck and said workpiece drive means disposed in the retracted position thereof, the workpiece drive means may be slided to the extended position thereof to drivingly engage, support and rotate said workpiece and, thereafter, slided to the retracted position thereof to disengage from said workpiece, said workpiece drive means comprising a drive socket which is shaped and sized complementally with regard to an end of said workpiece whereby, movement of said workpiece into said extended position thereof is effective to engage said workpiece end in said drive socket for support and rotation of said workpiece, said workpiece drive means and said chuck drive shaft being relatively arranged and disposed so that said drive shaft extends substantially into said workpiece drive means drive socket when said workpiece drive means are in the retracted position thereof whereby, said workpiece end will be forced from said drive socket upon movement of said workpiece drive means from the respective extended to retracted positions thereof thus insuring workpiece end-workpiece drive means disengagement.

2. In a ram drive chuck as in claim 1 wherein, said housing is generally cylindrical, and said ram drive chuck further comprises, a mounting foot extending from said housing and providing a generally flat chuck mounting surface for mounting of the chuck on a generally flat and horizontal chuck support surface.

3. In a ram drive chuck as in claim 1 wherein, said housing is generally cylindrical, and said ram drive chuck further comprises a generally cylindrical mounting flange extending generally radially outward therefrom and providing opposed generally flat chuck mounting surfaces for mounting of the chuck from generally flat and vertical chuck support surfaces.

4. In a ram drive chuck as in claim 1 wherein, said workpiece drive means comprise an externally keyed end portion which is sized and shaped complementally with regard to an internally key-wayed tubular end portion of said workpiece whereby, movement of said workpiece drive means into said extended position thereof is effective to engage said externally keyed workpiece end portion in said internally key-wayed tubular end portion of said workpiece for support and rotation of said workpiece.

5. In a ram drive chuck as in claim 1 further comprising, spaced port means in said housing respectively operable to admit pressurized fluid to opposite sides of said piston to drive said workpiece drive means between the respective extended and retracted positions thereof.

* * * * *